US005419016A

United States Patent [19]

Faas

[11] Patent Number: 5,419,016

[45] Date of Patent: May 30, 1995

[54] CASING OF A CARD INCLUDING SUCTION OPENINGS

[75] Inventor: Jürg Faas, Dinhard, Switzerland

[73] Assignee: Maschinenfabrik Rieter AG, Winterthur, Switzerland

[21] Appl. No.: 101,691

[22] Filed: Aug. 4, 1993

[30] Foreign Application Priority Data

Aug. 4, 1992 [CH] Switzerland ..... 02441/92

[51] Int. Cl.[6] ..... D01G 15/74

[52] U.S. Cl. ..... 19/98

[58] Field of Search ..... 19/98, 99, 107, 109, 19/200; 209/21, 24, 391, 393, 502, 606, 395; 406/34, 108, 117, 121, 144, 146, 191, 195, 151; 55/270, 418; 116/264, 266; 210/348, 478; 57/304, 308; 454/189, 49, 56, 195, 184, 66; 15/301

[56] References Cited

U.S. PATENT DOCUMENTS

| | | | |
|---|---|---|---|
| 3,308,344 | 3/1967 | Smith et al. | 19/200 X |
| 3,902,223 | 9/1975 | Rutz | 19/107 |
| 3,929,647 | 12/1975 | Kempa | 209/395 |
| 3,987,517 | 10/1976 | Bonalumi | 19/107 |
| 4,283,278 | 8/1981 | Savage et al. | 209/395 |
| 4,364,153 | 12/1982 | Beneke et al. | 19/200 X |
| 4,654,933 | 4/1987 | Horn et al. | 19/107 X |
| 4,985,966 | 1/1991 | Nitschkle et al. | 19/107 |
| 5,255,415 | 10/1993 | Leifeld et al. | 19/107 |

FOREIGN PATENT DOCUMENTS

| | | | |
|---|---|---|---|
| 0239549 | 9/1987 | European Pat. Off. . | |
| 2300828 | 10/1976 | France | 19/107 |
| 3316643 | 11/1984 | Germany . | |
| 0111095 | 9/1961 | Pakistan | 19/107 |
| 352935 | 4/1961 | Sweden . | |
| 408726 | 9/1966 | Sweden . | |
| 519031 | 3/1972 | Sweden . | |
| 0827630 | 5/1981 | U.S.S.R. | 19/107 |

*Primary Examiner*—Clifford D. Crowder
*Assistant Examiner*—Ismael Izaguirre
*Attorney, Agent, or Firm*—Burns, Doane, Swecker & Mathis

[57] ABSTRACT

A carding machine casing (1) is connected with a suction device (15) for preventing uncontrolled release of fibers and dust into the environment adjacent the machine, and the casing is provided with large suction openings (9, 10) having a combined area of not less than 0.5 $m^2$ for admitting conveying air to the interior of the casing. The air is sucked in through the large openings at a substantially lower flow speed so that a considerably lower proportion of the airborne particles and fibrous particles occurring in a spinning mill are sucked into the suction device (15). In many cases it is no longer necessary to provide for precise sealing of the casing (1), and it is sometimes feasible to omit the use of a filter cloth over the suction openings (9, 10) or to simplify the maintenance (e.g., cleaning) of the filter.

16 Claims, 1 Drawing Sheet

CASING OF A CARD INCLUDING SUCTION OPENINGS

FIELD OF THE INVENTION

This invention relates to textile fiber carding apparatus of the type in which the operating carding components of a carding machine are substantially enclosed in a casing. The invention is concerned with the flow of air into the interior of the card casing from the surrounding space in the mill and particularly with affecting the air streams which arise outside the card casing as a result of suction flows generated inside the casing.

BACKGROUND

Cards of modern design are generally surrounded by casings. Such a casing may be required by safety regulations. Also, such casings may be dictated by considerations relating to air purity. In order to effectively remove any fluff, trash particles or other dirt particles arising during the carding, suction means are connected to the interior of the casing to generate a pressure below atmospheric within the encased space. In this way fibrous particles, trash particles and other dirt particles are sucked away.

Presently known carding machines of this type are typified by the C4/1 offered by Maschinenfabrik Rieter and the DK740 of the Truetzschler company. In such machines, conveying air may be admitted to the interior of the card casing through one or several suction openings having a small combined suction area as compared to the total area of the casing. Such suction openings are covered by a screen grating which is partly provided with a filter cloth.

If the air streams generated in the atmosphere surrounding the casing flow with a significant velocity, they can draw dust, fly, debris and the like into the casing. If such material flows through the machine to the extractor fan of the cleaner system, no special problems arise. However, if the air streams entering the card casing are subjected to deceleration (or even sharp deviations), the air streams will tend to deposit the dust, fly, particulate material and other fiber debris which they carry into the casing. Such a depositing can occur at a position where no special cleaning system is provided. In other words, the air drawn into the casing for purposes of cleaning specific locations within the card casing actually contributes to accumulation of dirt, fly and debris at other positions within the casing.

The use of filter cloth positioned over the air inlet openings as mentioned above provides a way of addressing with this problem. However, the filter must be cleaned or replaced somewhat regularly to prevent the filter from becoming clogged and choking. If that occurs, the under-pressure in the casing draws air into the casing at any place possible—usually through cracks in the casing and thus at high flow rates. Consequently, the problem once again arises of depositing dust, fly and other particulate material at places where no special cleaning systems are provided.

Due to the large suction effect exerted in the existing machines, it is useful to seal the smaller gaps and openings which inevitably exist in connection with the casing of such a machine so as to prevent uncontrolled inflow of external air at unintended locations. To prevent such an inflow of air at unintended places, it is necessary that the best possible sealing be provided in the casing, so that external air is only sucked into the casing at the openings provided for this purpose.

SUMMARY OF THE INVENTION

The present invention provides for improving the suction of fiber fluff and trash and dirt particles occurring in the casing of a card in such a way that the requirements placed on the sealing and on the regular cleaning of the filter cloth can be reduced substantially. The present invention provides for a reduction in the rate of flow of air entering the card casing by significantly increasing the flow cross-section.

It is a feature of the invention that the card casing is provided with large suction openings having a combined area of at least 0.4, and preferably at least 0.5, square meters. With a suction device having a capacity of 0.5 to 1.2 $m^3$ per second, the suction flow velocity into the large suction openings of the casing (as measured outside the casing) will be less than 0.8 m/s and preferably less than 0.5 m/s. The suction openings preferably are covered by grids made up of lattice bars with spaces therebetween. The grids may themselves be covered with filter cloth if necessary.

An advantage of the invention is that the air streams within the card are substantially smaller, so that the sealing of the casing is no longer of such importance. The quantity of conveying air admitted to the interior of the card casing is larger, while the suction performance of the suction device remains the same, thus leading to improved removal of dust. As the air taken in flows into the casing at a substantially lower speed, the airborne particles such as fly fibers, etc. are taken in only to a very small extent and thus with a substantially lower volume flow density, so that in many cases it is possible to avoid using the filter cloth, for example, in cases where the spinning room is sufficiently clean.

BRIEF DESCRIPTION OF THE DRAWINGS

Other features and advantages of the invention will be evident from the following description, where the invention is outlined in greater detail by reference to an embodiment illustrated in the drawings, in which.

DETAILED DESCRIPTION OF ILLUSTRATED EMBODIMENT

Figure 1:
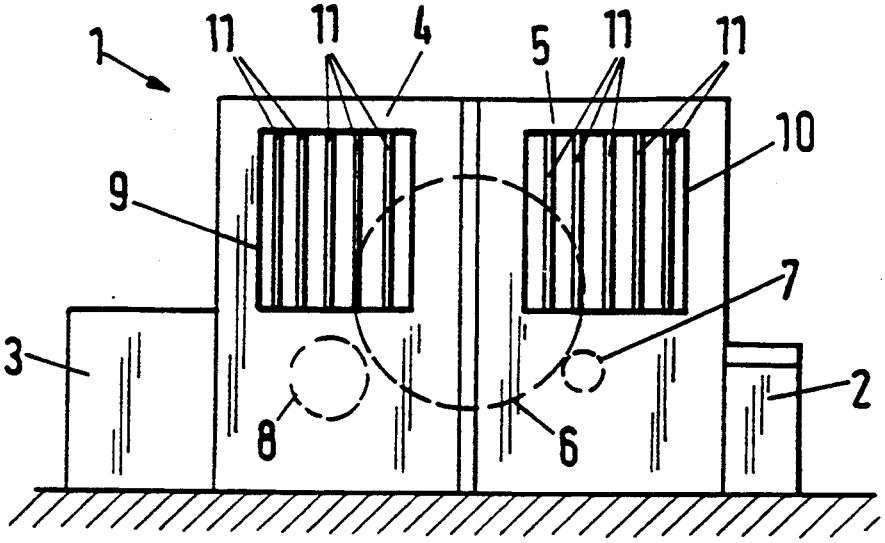
FIG. 1 shows a schematic representation of a side view of the casing of a card in accordance with the present invention.

FIG. 1 shows the casing 1 of a card in a highly schematic side view, without rigorous adherence to the actual dimensional relationships encountered in practice. A feed table 2 is situated on the right-hand side. A card sliver outlet 3 is shown on the left-hand side. The illustrated side of the casing 1 includes two doors 4 and 5, which cover the card. Some of the operating components of the card (e.g., the swift, drawing-in roller, licker-in, etc.) are indicated in broken lines. Rectangular suction openings 9 and 10 covered by lattice bars 11 are provided in the two doors 4 and 5.

Figure 2:
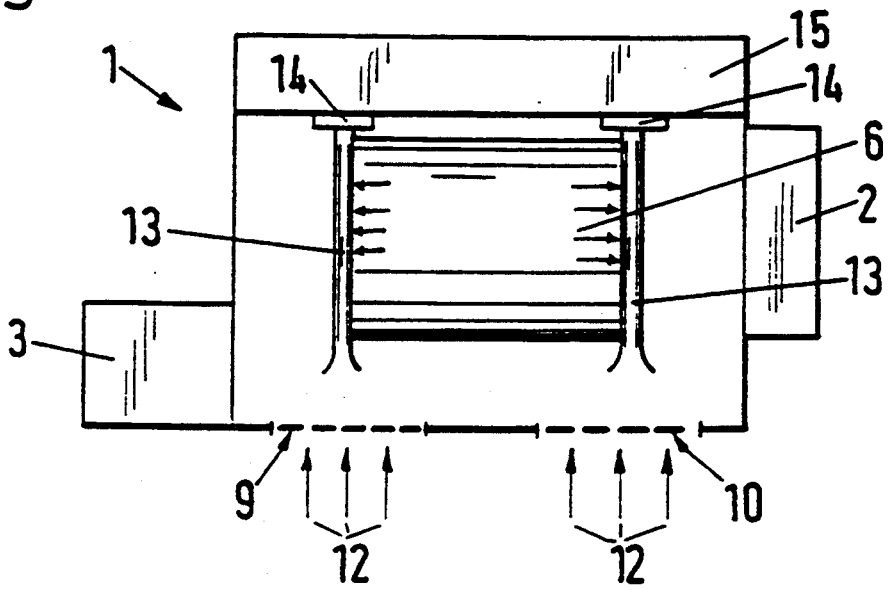
FIG. 2 shows a schematic top view (cross section) of the casing of FIG. 1.

FIG. 2 uses the same reference numerals for the same elements as in FIG. 1. A swift 6 is indicated with its circumference of rotation shown in a dash line. The air sucked in is represented by arrows 12. The air is taken in through the suction openings into the suction tubes 13 of an L-shaped duct 14 known from EP-A-0 340 458 and its U.S.A. counterpart U.S. Pat. No. 4,985,966, the disclosures of which are incorporated herein by reference. A suction device 15 with a suction capacity of typically 0.5 to 1.2 $M^3/s$, in particular 0.6 to 0.9 $M^3/s$, is arranged behind the duct 14. The spatial arrangement of the suction device 15 is not critical, and if desired, a single suction means may be arranged to act for several cards simultaneously.

Suction openings 9 and 10 (FIG. 1) are arranged as closely as possible to the suction positions of the suction tubes 13 in order to keep the air streams within the card as small as possible. Uncontrolled air streams within the casing of the card can lead to undesirable entrainments of fibers and dust and thus lead to the contamination of the interior of the machine.

In addition, by positioning portions of the suction tubes 13 relatively close to the air inlets, the air can flow directly from the inlet opening in the casing 1 to the collector openings of the suction system. Thus, to the extent rubbish or other debris is drawn in with the air flow, there exists a strong possibility it will flow through to the extractor. The arrows generally illustrated in FIG. 2 identify the positions of the collector openings that can be disposed at regular intervals along the length of the suction tubes 13.

Figure 3:
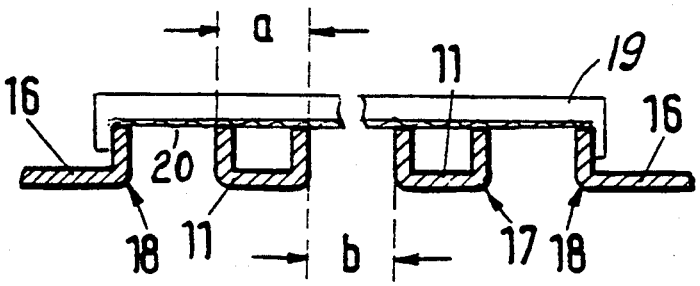
FIG. 3 shows a horizontal cross section through a suction opening provided with lattice bars as indicated in FIG. 1.

FIG. 3 shows a border strip 16 for the suction openings 9 or 10 with the lattice bars 11. Only two of the lattice bars 11 are shown in FIG. 3, but it will be understood from FIG. 1 that there are a larger number of such bars.

As is shown, the lattice bars 11 are provided with a U-shaped profile and the legs of the U are directed inwardly toward the interior of the casing 1. The U-shaped profile is folded or rounded off at the edges 17 so as to prevent the fibers from getting caught and collecting at the lattice bars so as ultimately to cover over the openings 9 and 10 and inhibit air flow therethrough. In this manner, a kind of self-cleaning effect is produced. The border strip 16 is also inwardly crimped and for this reason also has a folded or rounded edge 18.

The distance "a" between the outer sides of the legs of the U-shaped lattice bars 11 is between 10 and 40 mm, preferably approximately 20 mm. The distance "b" between two lattice bars 11 is not more than 40 mm, also measured between the outer sides of the legs, and is preferably approximately 20 mm.

The lattice bars 11 are arranged on and attached to one or more cross members 19 to form a linked grid. This grid is mounted from the inside of the casing into suction openings 9 and 10, so that the lattice bars 11 can only be removed from their operative positions when the otherwise locked doors 4 and 5 are opened. Furthermore, if the requirement should arise, it is possible to stretch a filter cloth 20 between the grid formed by the lattice bars 11 and the border strip of suction openings 9 and 10.

The effective suction area of suction openings 9 and 10 is the area formed by the suction openings 9 and 10 less the area covered by lattice bars 11. In accordance with the invention, this effective suction area must be at least 0.4 $m^2$, and preferably not less than 0.5 $m^2$, in order to achieve the desired slow air speed of maximally 0.3 to 0.8 m per second, for the air entering the openings 9 and 10. Such air speeds are measured outside of the casing 1 and in the vicinity of suction openings 9 and 10.

In the preferred embodiment, therefore, the total flow area into the casing is made up of a plurality of smaller areas that are separated by elements (i.e., the lattice bars 11) which have a diffuser effect on the exterior of the casing. That is, the lattice bars 11 and the resulting plurality of small flow areas that combine to define the total flow area improve the suppression of high velocity air flows in the neighborhood of the casing. The flow lines along which air flows into the casing converge onto the openings which give access to the low pressure within the casing. Thus, if the flow velocity of the entrance opening is V, the velocity at the place spaced from the opening where the flow lines join can be considerably lower, say V/2. In contrast, if a single opening having the same total flow area were provided, the speed of the air flow at the entrance opening would be maintained over a much greater distance from that entrance opening.

The diffusing effect discussed above can be characterized by the relationship between the area enclosed by an envelope drawn around the outer extremities of the array of inflow openings and the actual effective inflow area. Such an envelope preferably encloses an area that is at least fifty percent, and preferably about one-hundred percent, greater than the actual effective inflow area.

From a safety standpoint, the provision of a plurality of separated smaller flow areas which define the total flow area is advantageous as it avoids larger openings through which a hand can pass.

The air inflow openings are preferably provided in the upper part of the casing in alignment with the cleaning points disposed on the upper part of the main carding cylinder. Preferably, there are no cleaning points, or only relatively few cleaning points, on the region of the lower half of the main cylinder.

The present invention, therefore, reduces the air flow outside the card housing (in the spinning room) in order to prevent dust, debris, fluff and the like from being drawn into the housing. By reducing the speed of the air flow in comparison to other known devices and by spreading apart the positions at which the air is drawn into the card housing or casing, reduced air flow outside the card casing can be achieved.

What is claimed is:

1. In textile fiber carding apparatus, a carding machine casing adapted to enclose operating components of a carding machine and to be connected to a suction device for removing particulate matter in a current of conveying air from the interior of the casing, said casing having suction openings therein for admitting conveying air to an interior of the casing, said suction openings defining a combined opening area in the casing through which conveying air is admitted to the interior of the casing, said combined opening area being not less than 0.4 square meters.

2. Textile fiber carding apparatus comprising operating components for carding fibers, a casing enclosing said operating components to inhibit uncontrolled release of particulate matter to the surrounding environment, and suction means connected to said casing for removing the particulate matter from said casing in a current of conveying air, said casing having suction openings therein for the passage of conveying air from the surrounding environment into an interior of said casing and said suction openings defining a combined opening area in the casing through which conveying air is admitted to the interior of the casing, said combined opening area in the casing being at least 0.5 square meters.

3. Textile fiber carding apparatus according to claim 2, wherein said suction means has a suction capacity of 0.5 to 1.2 cubic meters per second and wherein the suction flow measured outside said casing in the vicinity of said suction openings is less than 0.8 meters per second.

4. Textile fiber carding apparatus according to claim 3, wherein measured suction flow is less than 0.5 m per second at a suction capacity for the suction means of 0.6 to 0.9 $m^3$ per second.

5. Textile fiber carding apparatus according to claim 2, wherein said suction openings are covered by grid means made up of lattice bars having edge portions which are rounded off to inhibit catching fibers thereon.

6. Textile fiber carding apparatus according to claim 5, wherein the distance between adjacent ones of said lattice bars is less than 40 mm.

7. Textile fiber carding apparatus according to claim 6, wherein said distance between lattice bars is about 20 mm.

8. Textile fiber carding apparatus according to claims 5, wherein said suction openings are rectangular and wherein said lattice bars are U-shaped in cross section.

9. Textile fiber carding apparatus according to claim 5, wherein said grid means is mounted from the interior of said casing so that the grid means is positioned between said operating components and said suction openings.

10. Textile fiber carding apparatus according to claim 9, including a filter cloth stretched between the mountable grid means and a border strip of the suction openings.

11. Textile fiber carding apparatus according to claim 2, including suction tubes provided within said casing in the vicinity of said operating components and being connected to said suction means, said suction openings in said casing being arranged closely adjacent the positions of said suction tubes.

12. A carding machine casing comprising wall means substantially enclosing operating components of a carding machine to inhibit the uncontrolled passage of fibers and dust into the surrounding environment, suction openings provided in the wall means, said suction openings having a combined opening area of least 0.4 $m^2$ for admitting air into the interior of said casing from the vicinity of the exterior of said casing, and lattice bars extending across said suction openings to divide the air flow through the suction openings.

13. A carding machine casing according to claim 12, including doors, wherein said suction openings are in said doors and wherein said lattice bars form grid means mountable in said openings from the inside of said casing when said doors are open.

14. A carding machine according to claim 13, including porous filter means covering said grid means.

15. A carding machine casing having an interior that is to be connected to a suction source to remove particulate matter from an interior of the casing, comprising wall means substantially enclosing operating components of a carding machine to inhibit uncontrolled passage of fibers and dust into a surrounding environment, said wall means being provided with means for allowing an inflow of air into an interior of the casing from regions adjacent an exterior of the casing, said means for allowing an inflow of air providing a total inflow area through which air flows into the interior of the casing, the total inflow area being at least 0.4 $m^2$ and being comprised of a plurality of smaller inflow areas that are separated by elements which suppress high velocity air flow entering the casing.

16. A carding machine casing according to claim 15, wherein said means for allowing an inflow of air includes at least one opening in the casing and a plurality of lattice bars which extend across the opening to form the smaller inflow areas.

* * * * *